US005673847A

United States Patent [19]

Swink

[11] Patent Number: 5,673,847

[45] Date of Patent: Oct. 7, 1997

[54] CONTAINER FOR CYLINDER GAS TANKS

[76] Inventor: Arthur R. Swink, 701 River Bend Dr., Rochester Hills, Mich. 48307-2426

[21] Appl. No.: 524,747

[22] Filed: Sep. 7, 1995

[51] Int. Cl.[6] ..... B65D 5/468

[52] U.S. Cl. ..... 229/113; 229/117.17; 229/168

[58] Field of Search ..... 229/113, 117.16, 229/117.17, 168, 174

[56] References Cited

U.S. PATENT DOCUMENTS

| | | | |
|---|---|---|---|
| 2,242,741 | 5/1941 | Betts et al. | 229/113 |
| 2,318,198 | 5/1943 | Clarke | 229/168 |
| 2,519,831 | 8/1950 | Frankenstein | 229/113 |
| 2,646,915 | 7/1953 | Bockmann | 229/113 |
| 2,705,589 | 4/1955 | Steele | 229/168 |
| 2,954,914 | 10/1960 | Herlihy | 229/117.17 |
| 2,961,143 | 11/1960 | Forrer | 229/113 |
| 3,516,594 | 6/1970 | Stenzel et al. | 229/117.17 |
| 3,895,754 | 7/1975 | Rosenberg, Jr. | 229/113 |

FOREIGN PATENT DOCUMENTS

| | | | |
|---|---|---|---|
| 4930 | 11/1956 | Germany | 229/168 |
| 2155441 | 9/1985 | United Kingdom | 229/113 |

*Primary Examiner*—Gary E. Elkins
*Attorney, Agent, or Firm*—Harness, Dickey & Pierce, P.L.C.

[57] ABSTRACT

A container has a rectangular base and side walls inwardly extending from the base to provide a truncated tetrahedron shape with an open top. Handles are on opposing side walls to enable the carrying of the container.

5 Claims, 2 Drawing Sheets

Fig - 3
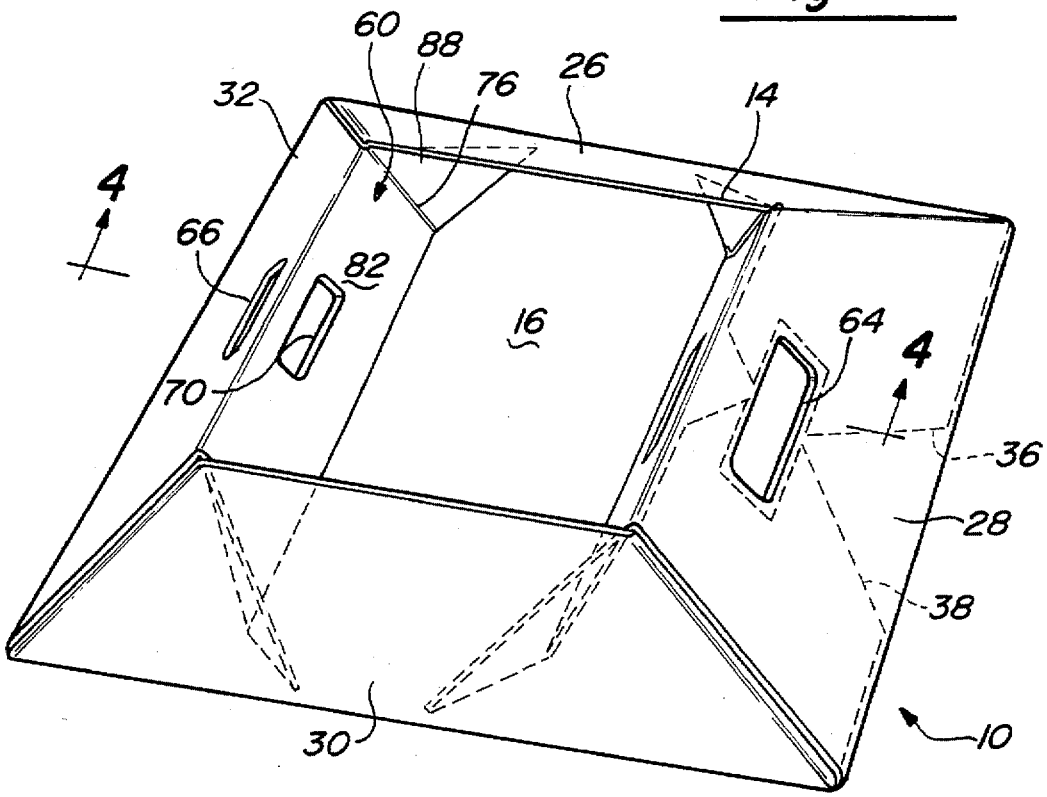
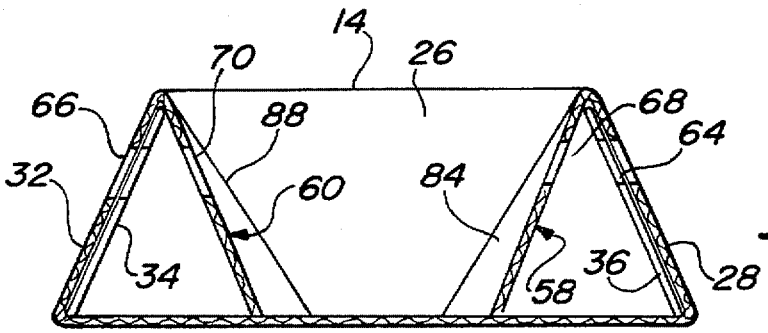
Fig - 4
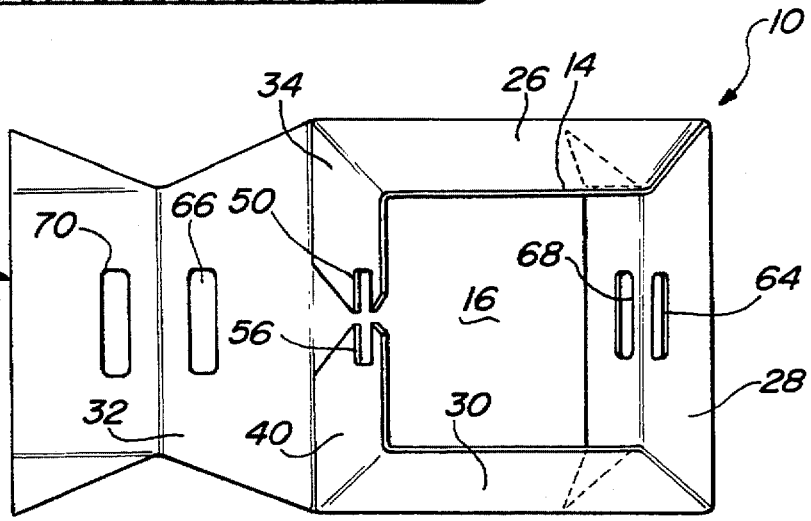
Fig - 5

CONTAINER FOR CYLINDER GAS TANKS

BACKGROUND OF THE INVENTION

The present invention relates to containers and, more particularly, to containers for carrying propane gas cylinders.

SUMMARY OF THE INVENTION

Propane cylinders which are used with barbecue gas grills or the like ordinarily are bulky and awkward to transport. Generally the tanks include a cut-out in the annular port surrounding the valve to enable a user to position their hand through the cut-out to carry the tank. When the tank is empty, the tank is relatively light and easy to carry holding onto the cut-out. However, when the tank is full of propane gas, the tank is relatively heavy and carrying the tank, via the cut-out, places undue force on the user's hand. Thus, it would be desirable to have a carrier or container for the gas cylinder tanks which enables easy transport by the user.

Accordingly, it is an object of the present invention to provide a container which enables transport of gas cylinder tanks. The present invention enables the user to easily carry the gas cylinder tank. Also, the present invention enables transport of the cylinder in a vehicle tank or the like without the cylinder moving wildly within the vehicle. Further, the present invention provides a container manufactured from a heavy corrugated paper board box construction which may be folded into a use position for transporting the gas cylinder tank and which may be knocked down into a storage or non-use position.

From the following detailed description taken in conjunction with the accompanying drawings and appended claims, additional objects and advantages of the invention will be apparent to those skilled in the art.

BRIEF DESCRIPTION OF THE DRAWINGS

FIG. 3 is a top perspective view of the container in accordance with the present invention.

FIG. 4 is a cross-section view along lines 4—4 of FIG. 3.

FIG. 5 is an elevation view of the container of FIG. 3 with the flap back.

DETAILED DESCRIPTION OF THE PREFERRED EMBODIMENT

Figure 1:
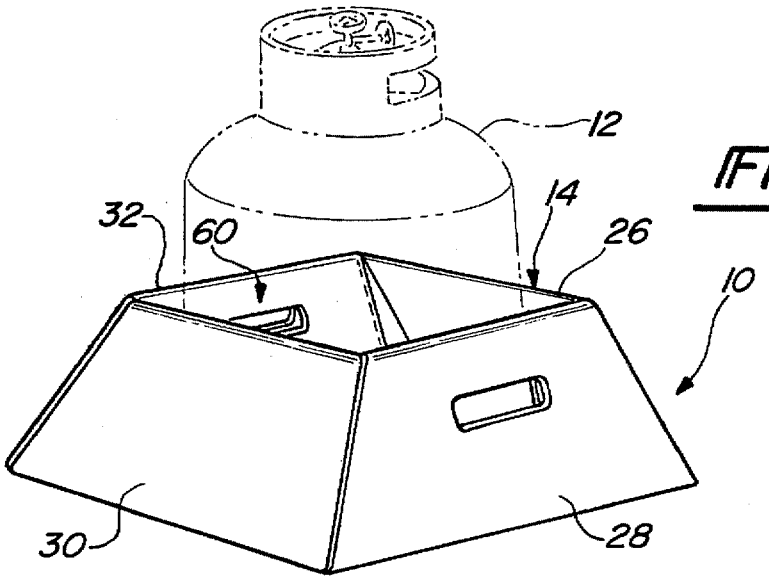
FIG. 1 is a perspective view of a container and a gas cylinder tank in accordance with the present invention.

Turning to the figures, particularly FIG. 1, a container in accordance with the invention is shown and designated with the reference numeral 10. As can be seen, the container 10 is designed to hold a gas cylinder tank 12. The container 10 is manufactured from corrugated paper board material and has an overall truncated tetrahedron configuration with an open top 14.

Figure 2:
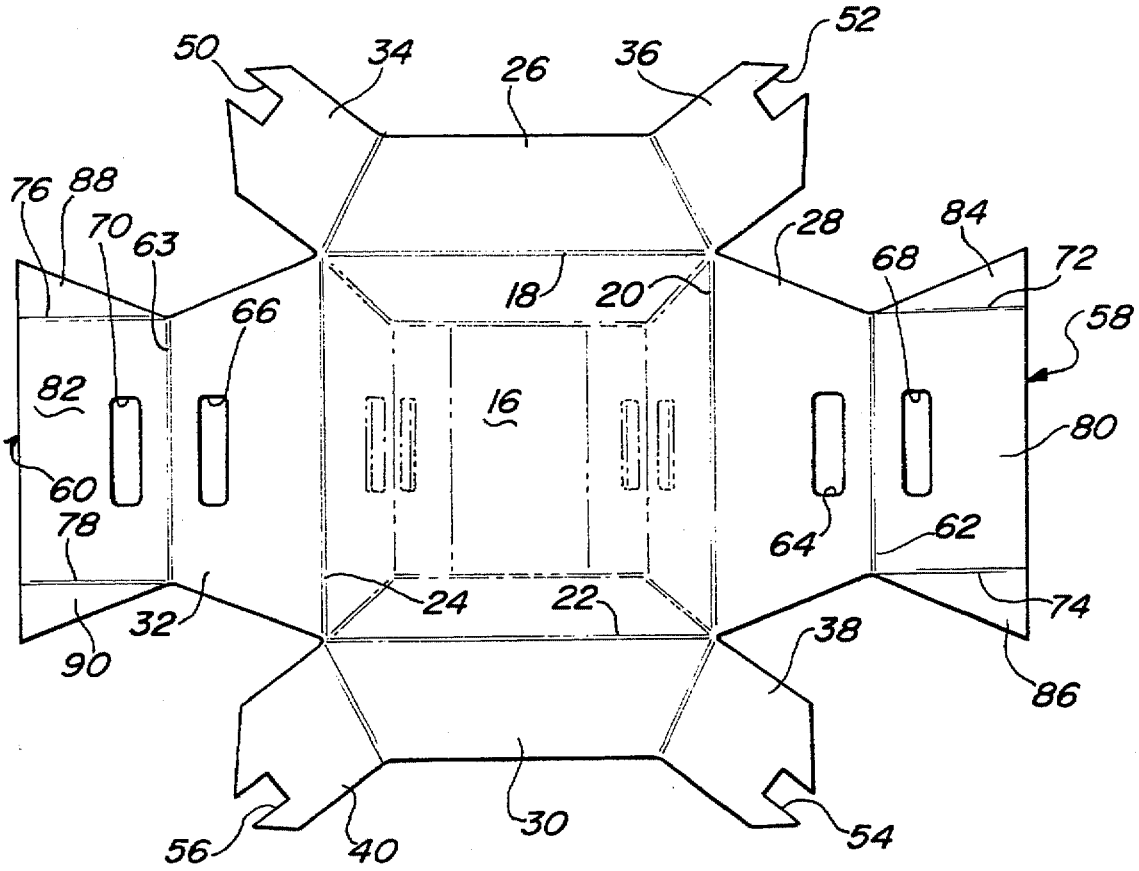
FIG. 2 is a plan view of a blank in accordance with the present invention with the blank folded in phantom to form the container.

The parts of the container 10 can best be explained with respect to the blank of FIG. 2. The container 10 includes a rectangular base 16 which in some circumstances may be square. The base 16 has four edges 18, 20, 22 and 24 which define fold lines for side walls 26, 28, 30 and 32, which extend from the base 16. The side walls 26 and 30, as well as side walls 28 and 32, are identical with respect to one another and an explanation of one will equally apply to the other.

The side walls 26 and 30 have a trapezoidal shape with a pair of end flaps 34, 36, 38 and 40, extending from the non-parallel sides of the trapezoid. Fold lines 42, 44, 46 and 48 are formed between the ends 34, 36, 38 and 40 respectively, and the trapezoidal side walls 26 and 30. The ends 34, 36, 38 and 40 have an overall diamond shaped configuration with a truncated vertice. Also each end includes a cut-out 50, 52, 54 and 56 which enables passage of a hand of the user.

The side walls 28 and 32 are part of a hexagonal hourglass shape side which extends from the fold lines 20 and 24. The side walls 28 and 32 include flaps 58 and 60. The side walls 28 and 32 as seen in FIG. 1 have an overall trapezoidal shape. Also the flaps 58 and 60 have an overall trapezoidal shape which is identical to the walls 28 and 30 and if folded along fold lines 62 and 63 would identically cover the side walls 28 and 32. The side walls 28 and 32 and flaps 58 and 60 include apertures 64, 66, 68 and 70 which provide a handle for carrying by the user. The cut-outs form a handle on the side walls 28 and 32. Also, a pair of apertures could be in each side wall 28 and 32 enabling securement of an attachable handle (not shown).

The flaps 58 and 60 include score lines 72, 74, 76 and 78 which divide the flaps 58, 60 into a rectangular section 80 and 82 and two triangular sections 84, 86, 88 and 90. The score lines 72, 74, 76 and 78 enable the triangular sections 84, 86, 88 and 90 to fold along the score lines such that the triangular portions 84, 86, 88 and 90 may fold into the plane of the drawing or out of the plane of the drawing as seen in FIG. 2. This is significant for folding the blank into its carrying position and for knocking down the blank into its storage position.

The blank is folded into its use position by moving side walls 26 and 30 inwardly with respect to the base 16 (See FIGS. 2 and 5). Also, the ends 34, 36, 38 and 40 would be folded along fold lines 42, 44, 46 and 48 and folded such that the side walls 26 and 30 extend over the base as seen in FIGS. 3 and 5. Also, the ends 34, 36, 38 and 40 are in a plane parallel to the plane of walls 28 and 32, respectively. Side walls 28 and 32 would be folded inward such that the flaps 58 and 60 would move inward and rest on the base 16 as illustrated in FIGS. 3 and 5. When this happens, the ends 34, 36, 38 and 40 are adjacent the side walls 28 and 32 as seen in FIG. 4. Also, the cut-outs 50, 52, 54 and 56 are aligned with the apertures 64, 66, 68 and 70 to enable passage of a hand through the handle. As the flaps 58 and 60 are folded inside of the side walls 26 and 30, the triangular portions 84, 86, 88 and 90 would bend upward as the flaps 58, 60 contact walls 26 and 30 and enter the inside of the container 10. Once flaps 58 and 60 are inside of the container 10, the triangular portions 84, 86, 88 and 90 resiliently spring back into a position planar with the rectangular portion 80, 82 to provide a trapezoidal flap. When the flaps 58 and 60 are removed from inside of the container 10, the triangular portions 84, 86, 88 and 90 again contact walls 26 and 30 and fold in an opposite direction along the score lines 72, 74, 76 and 78 to enable the flaps to be pulled out from within the container 10.

Once the container is in its use position, the flaps 58 and 60 are at an angle with respect to side walls 28 and 32 (FIGS. 1 and 3). An acute angle is defined between the side walls 28 and 32 and the flaps 58 and 60 and a dead space is formed between the two as seen in FIG. 4. Also, as seen in FIG. 4, when the ends 34, 36, 38 and 40 are folded inward, they are positioned along the fold line 24 and are at an angle substantially equal to the angle of the walls 28 and 32 so that they provide additional reinforcement to the wall structure.

Thus, in the use position, the container can carry gas cylinder tanks like those used in portable barbecue gas grills.

While the above detailed description describes the preferred embodiment of the present invention, the invention is susceptible to modification, variation, and alteration without deviating from the scope and fair meaning of the subjoined claims.

I claim:

1. A corrugated paper container comprising:

a rectangular base;

four side walls extending inward from said base toward one another to provide the container with a truncated tetrahedron appearance;

a pair of flaps on two opposing of said side walls, said pair of flaps extending into said container and defining an acute angle between said pair of flaps and said two opposing side walls such that said pair of flaps are at an acute angle with respect to a vertical plane and extending into and toward the center of the container; and apertures in said two opposing side walls and said pair of flaps for providing handles in said container.

2. The container according to claim 1, wherein said other pair of side walls including end portions, said end portions being tucked between said pair of flaps and side walls and being adjacent said two opposing side walls.

3. The container according to claim 2, said end portion including cut-outs aligning with one said apertures.

4. The container according to claim 1, wherein said pair of flaps are angled with respect to said extending two opposing side walls such that a dead space is formed between said two opposing side walls and said pair of flaps.

5. The container according to claim 1, wherein said pair of flaps have a trapezoidal shape with a pair of score lines dividing each of said pair of flaps into a rectangular section and two triangular sections, said score lines enabling movement of said triangular portions with respect to said rectangular portion to enable positioning of the pair of flaps within the container.

* * * * *